US007798483B2

(12) United States Patent
Oomori

(10) Patent No.: US 7,798,483 B2
(45) Date of Patent: Sep. 21, 2010

(54) SHEET FEEDER AND IMAGE FORMING APPARATUS

(75) Inventor: Akira Oomori, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 403 days.

(21) Appl. No.: 11/937,691

(22) Filed: Nov. 9, 2007

(65) Prior Publication Data

US 2008/0116626 A1 May 22, 2008

(30) Foreign Application Priority Data

Nov. 16, 2006 (JP) ..... 2006-310816

(51) Int. Cl.
*B65H 3/06* (2006.01)

(52) U.S. Cl. ..... 271/118; 271/117; 271/121; 271/273

(58) Field of Classification Search ..... 271/117, 271/118, 121, 273
See application file for complete search history.

(56) References Cited

U.S. PATENT DOCUMENTS

| | | | | |
|---|---|---|---|---|
| 4,850,581 | A * | 7/1989 | Hayakawa et al. | 271/10.06 |
| 5,244,197 | A * | 9/1993 | Helmstadter | 271/35 |
| 5,333,848 | A * | 8/1994 | Rubscha | 271/3.14 |
| 5,370,380 | A * | 12/1994 | Suzuki et al. | 271/21 |
| 5,678,817 | A * | 10/1997 | Saito et al. | 271/122 |
| 6,152,442 | A * | 11/2000 | Nishinohara et al. | 271/121 |
| 6,203,003 | B1 * | 3/2001 | Sato et al. | 271/3.01 |
| 6,554,270 | B2 * | 4/2003 | Yamamoto | 271/117 |
| 6,792,241 | B2 * | 9/2004 | Nakagawa et al. | 399/367 |
| 6,908,800 | B1 | 6/2005 | Kim et al. | |
| 7,607,655 | B2 * | 10/2009 | Oomori et al. | 271/117 |
| 2002/0117800 | A1 * | 8/2002 | Kawarama et al. | 271/121 |
| 2005/0164443 | A1 | 7/2005 | Kim et al. | |
| 2006/0038339 | A1 * | 2/2006 | Shimamura | 271/121 |

FOREIGN PATENT DOCUMENTS

| | | |
|---|---|---|
| JP | 2001-007221 | 1/2001 |

* cited by examiner

*Primary Examiner*—Saúl J Rodríguez
*Assistant Examiner*—Howard Sanders
(74) *Attorney, Agent, or Firm*—Fitzpatrick, Cella, Harper & Scinto

(57) ABSTRACT

When a sheet reaches a sheet separator, an operation mechanism rocks a pick arm, thereby separating a paper feed roller from the sheet. At that time, a roller presses another roller and a separation pad holder through a separation roller and a sheet which is separated by the separation pad, and a pressure welding pressure between the separation roller and the separation pad is reduced. With this, the separation roller and the separation pad can be separated from each other with a small and simple mechanism, and a back tension when a sheet is fed can be reduced inexpensively.

6 Claims, 11 Drawing Sheets

SHEET FEEDER AND IMAGE FORMING APPARATUS

BACKGROUND OF THE INVENTION

1. Field of the Invention

The present invention relates to a sheet feeder and an image forming apparatus, and more particularly, to a mechanism for feeding sheets one sheet by one sheet.

2. Description of the Related Art

A conventional image forming apparatus such as a printer or a copier includes a sheet feeder for feeding sheets to an image forming portion. Some sheet feeders include a paper feed roller for feeding sheets set in a sheet tray, a sheet separator for separating for separating the fed sheets one sheet by one sheet, and a convey roller which is provided downstream of the sheet separator and which conveys the separated sheet. The sheet separator brings the separation pad into contact with the paper feed roller under pressure, and the sheets are separated from each other between the paper feed roller and the separation pad. In the separation pad type sheet separator, the separated sheet is conveyed by the convey roller and the sheet is sandwiched between the paper feed roller and the separation pad. Therefore, this sheet separator has a problem that a back tension (load) when the sheet is conveyed is high. Hence, there is a technique in which the separation pad is separated from the paper feed roller after the sheet is separated, the sheet is applied a force toward the separation pad by a rotatable roller, thereby reducing the back tension when a sheet is fed. This technique is disclosed in Japanese Patent Application Laid-open No. 2001-7221.

A conventional sheet feeder which applies a force of a rotatable roller toward the separation pad will be described with reference to FIGS. 11.

According to a sheet feeder shown in FIG. 11A, in an initial state of the sheet feeding operation, a middle plate 102 which can be rocked by a release cam (not shown) is pushed down to a predetermined standby position. With this, a sheet P on the middle plate 102 and a paper feed roller 103 are isolated from each other. The separation pad holder 104 is pushed down through a separation pad holder pressing portion 105 of the middle plate 102 and thus, the separation pad 106 is isolated from the paper feed roller 103. The roller 107 is applied a force toward the separation pad 106 under predetermined pressure. A return lever 108 which returns a sheet lying from the middle plate 102 to the separation pad 106 completes its returning operation, and is located on a state where the return lever 108 is retreated from a convey path of the sheet P.

If the sheet feeding operation is started, as shown in FIG. 11B, the middle plate 102 starts moving upward. At that time, the position restriction where the separation pad holder pressing portion 105 of the middle plate 102 acts is released and with this, the separation pad holder 104 starts moving upward. The paper feed roller 103 and the separation pad 106 abut against each other before the paper feed roller 103 and the sheet P on the middle plate 102 abut against each other by the setting of the action stroke. Therefore, even if the sheet P is brought into an unstable state by the movement of the middle plate 102, since the separation pad 106 and the paper feed roller 103 abut against each other first, the sheet P does not enter forward of the separation pad 106.

Next, the paper feed roller 103 and the middle plate 102 are pressed through the sheet P as shown in FIG. 11C. Then, as shown in FIG. 11D, the sheet P is picked up as the paper feed roller 103 rotates, and the paper feeding operation is carried out. If the uppermost fed sheet P passes through the sheet tip end detecting sensor (not shown) and is sandwiched between a convey roller (not shown) and a pinch roller (not shown), the separation pad 106 is separated from the paper feed roller 103. At that time, the separation pad 106 and the paper feed roller 103 are separated from each other after the middle plate 102 and the paper feed roller 103 are separated from each other as shown in FIG. 11E. With this, even if the set sheets become unstable by the movement of the middle plate 102, since the separation pad 106 and the paper feed roller 103 abut against each other, the sheet does not come forward of the separation pad 106. The sheet P which is conveyed and on which an image is formed is applied a force to the separation pad 106 by the roller 107, subsequent sheet is prevented from falling.

If image formation onto the sheet P is carried out and the discharging operation is completed, the return lever acting cam 110 rotates to act on the return lever 10 as shown in FIG. 11F, and the sheet lying on the separation pad 106 is returned to a loading position. If the return lever acting cam 110 further rotates and does not act on the return lever 108, the return lever 108 returns to its initial position shown in FIG. 11A by its own weight.

When the above-described series of sheet feeding operation is completed and the next sheet P is to be fed, the above-described operation is repeated.

The sheet feeder described in the description of the related art includes the rockable middle plate, and the loaded sheets are fed by moving the middle plate. The paper feed roller and the separation pad are separated from each other during the paper feeding operation in association with movement of the middle plate. Therefore, back tension generated by them is reduced.

In the mechanism for reducing the back tension as described above, however, there is a problem that the application of the mechanism is limited to a sheet feeder using the middle plate. Further, in the mechanism for reducing the back tension, a relatively large member, i.e., the middle plate must move. Thus, it is difficult to simplify and reduce the size of the mechanism itself and thus, the entire sheet feeder.

If the sheet feeder is reduced in size, a guide space through which a sheet is conveyed becomes narrow. As a result, the conveying direction of a sheet is changed many times and the curve of each charge becomes acute. Thus, when the feeding direction is abruptly changed immediately after the sheet passes through the paper feed roller, there is a problem that a rear end of the sheet jumps and an impact noise is generated.

SUMMARY OF THE INVENTION

The present invention has been accomplished in view of the above circumstances, and it is an object of the invention to provide a sheet feeder and an image forming apparatus capable of reducing back tension inexpensively, and stably feeding a sheet.

The present invention provides a sheet feeder including a sheet tray which supports sheets, a paper feed roller which feeds the sheets supported by the sheet tray, and a sheet separator having a separation roller and a separation member which separates a sheet fed from the paper feed roller one by one, the sheet feeder comprising;

a holding member which holds the separation member and which is applied a force in a direction where the separation member comes into contact with the separation roller, a rockable arm member which is rockable provided an holds the paper feed roller on an upstream side in a sheet feeding direction, and which has a pressing portion capable of pressing the holding member on a downstream side in the sheet feeding direction, and an operation mechanism which rocks the arm member in a direction where the paper feed roller is separated from the sheets supported by the sheet tray and the pressing portion presses the holding member.

Further features of the present invention will become apparent from the following description of exemplary embodiments (with reference to the attached drawings).

DESCRIPTION OF THE EMBODIMENTS

Figure 1:
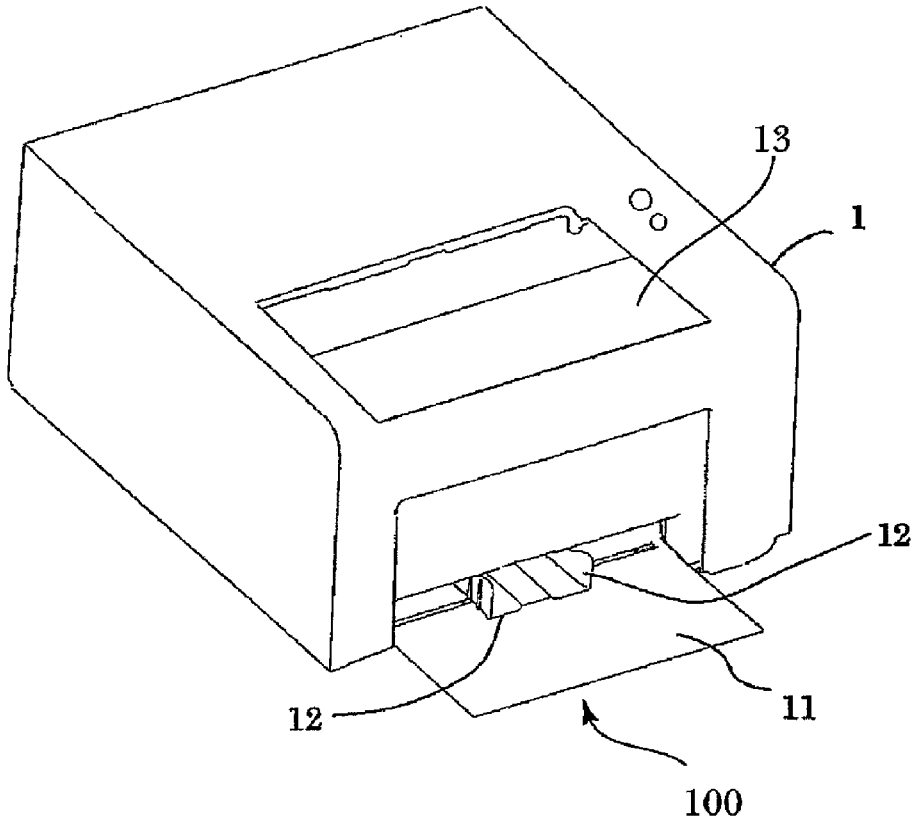
FIG. 1 is a perspective view of an image forming apparatus having a sheet feeder according to a first embodiment of the present invention.
Figure 2:
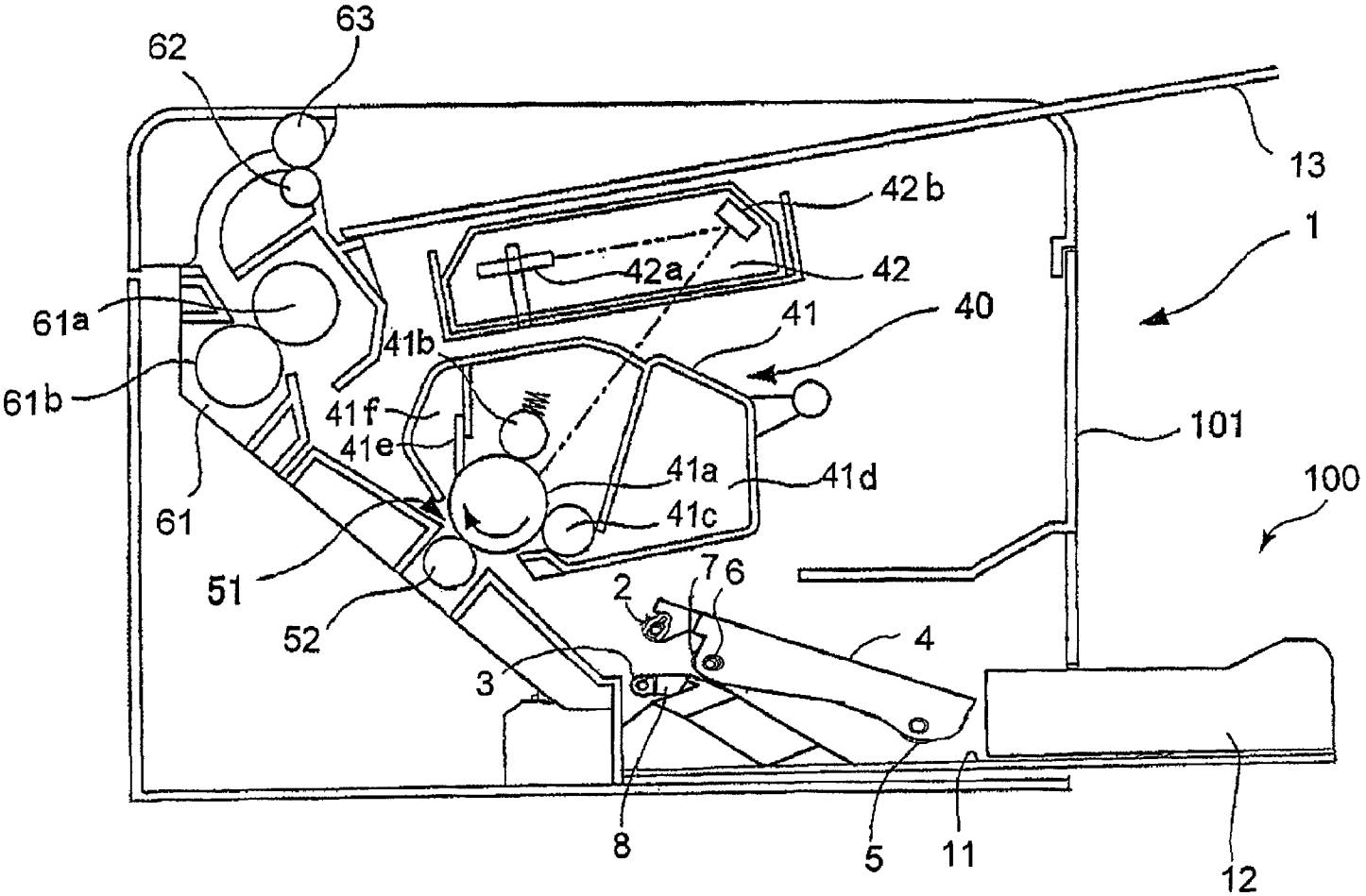
FIG. 2 is a schematic diagram showing a structure of the image forming apparatus having the sheet feeder according to the embodiment.

The best mode for carrying out the present invention will be described in detail using the drawings. FIG. 1 is a perspective view of an image forming apparatus having a sheet feeder according to a first embodiment of the present invention. FIG. 2 is a schematic diagram showing a structure of the image forming apparatus having the sheet feeder according to the embodiment.

That is, the image forming apparatus 1 is provided at its lower portion with a sheet feeder 100 for feeding sheets, and with an image forming portion 40 for forming an image on a sheet S fed from the sheet feeder 100. As shown in FIG. 2, the image forming apparatus 1 also includes a transfer portion 51 for transferring a toner image to the sheet, and a fixing portion 61 for fixing the toner image transferred by the transfer portion 51 to the sheet.

The image forming portion 40 includes a process cartridge 41 having a photosensitive member drum 41*a*, a developing sleeve 41*c*, a charging roller 41*b* and a toner container 41*d*. The image forming portion 40 includes a laser scanner 42 for exposing a surface of the photosensitive member drum 41*a* to the light and forming an electrostatic latent image on the photosensitive member drum 41*a*. The laser scanner 42 includes a laser light-emitting portion (not shown), a rotating polygon mirror 42*a* and a folded mirror 42*b*.

Figure 3:
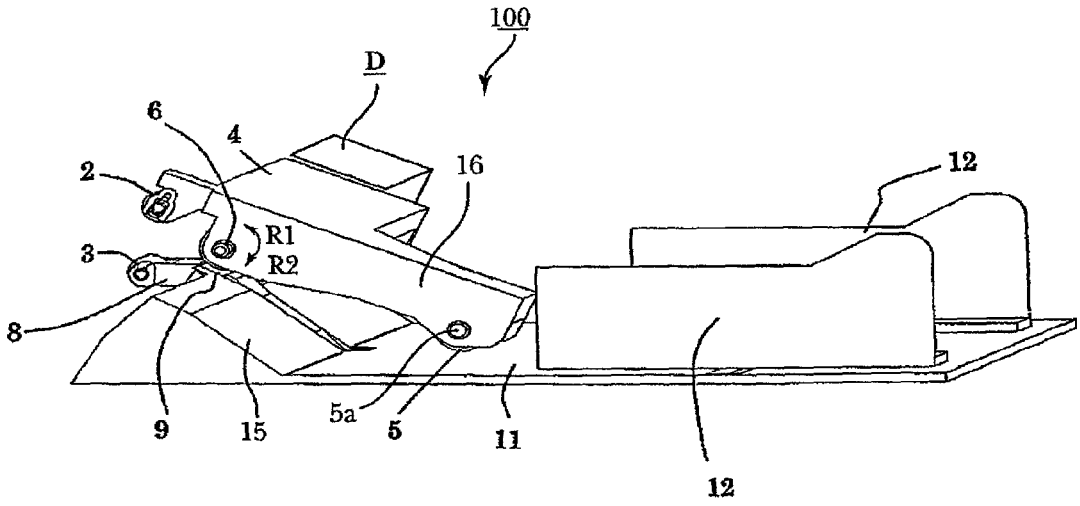
FIG. 3 is a perspective view of only the sheet feeder.

The sheet feeder 100 includes a sheet tray 11 in which sheets are accommodated, a paper feed roller 5 for feeding sheets on the sheet tray 11, and a separation roller 7 for separating the sheet fed from the paper feed roller 5 between the separation pad 9 shown in FIG. 3 and the separation roller 7 and conveying the sheet. The sheet tray 11 is provided with width limiting members 12 for limiting a position in a widthwise direction intersecting with a sending direction of the sheet. When an image is to be formed by the image forming portion 40, a user manually inserts and sets paper sheets between the width limiting members 12.

The transfer portion 51 includes a photosensitive member drum 41*a*, and a transfer roller 52 which comes into contact with the photosensitive member drum 41*a* under pressure to form a transfer nip. When a sheet passes through the transfer nip, the transfer roller 52 transfers a toner image on the photosensitive member drum 41*a* to the sheet. The fixing portion 61 includes a heating roller 61*a* and a pressure roller 61*b* which comes into contact with the heating roller 61*a* under pressure.

Next, an image forming operation of the image forming apparatus 1 having such a structure will be described.

If the image forming operation is started, the photosensitive member drum 41*a* first rotates in the direction of the arrow (see FIG. 2), and the photosensitive member drum 41*a* is uniformly charged with predetermined polarity and predetermined potential by the charging roller 41*b* to which electricity is supplied from a high pressure power supply (not shown). In this manner, the surface of the photosensitive member drum 41*a* is charged. Then the photosensitive member drum 41*a* is irradiated with laser beam based on image information at a later-described timing from a laser light-emitting portion (not shown) of the laser scanner 42. The photosensitive member drum 41*a* is irradiated with laser beam through the polygon mirror 42*a* and the folded mirror 42*b* and an electrostatic latent image is formed on the photosensitive member drum 41*a*.

Toner in the toner container 41*d* is appropriately charged by rotation of the developing sleeve 41*c*, and the toner is supplied onto the photosensitive member drum 41*a* and adhered to the electrostatic latent image the image is developed and made visible as a toner image.

With the toner image forming operation, sheets accommodated in the sheet tray 11 are sent to the paper feed roller 5, the sheets are separated and conveyed by the separation pad 9 and the separation roller 7, and conveyed to the transfer portion 51. A toner image formed on the photosensitive member drum 41*a* by the transfer portion 51 is transferred onto a predetermined position on the sheet S by the transfer roller 52.

Next, the sheet S on which the toner image is transferred is conveyed to a fixing nip comprising a heating roller 61*a* and a pressure roller 61*b* provided on the fixing portion 61. Here, non-fixed toner image is heated, pressurized and fixed to a sheet surface. The sheet after the toner image is fixed thereto is discharged onto a discharge tray 13 by a pair of discharge rollers 62 and 63. Residual toner which is not transferred and remains on the photosensitive member drum 41*a* is accommodated in a toner waste container 41*f* by a cleaning blade 41*e*. The photosensitive member drum 41*a* whose surface is cleaned is repeatedly brought into next image forming process.

Figure 4:
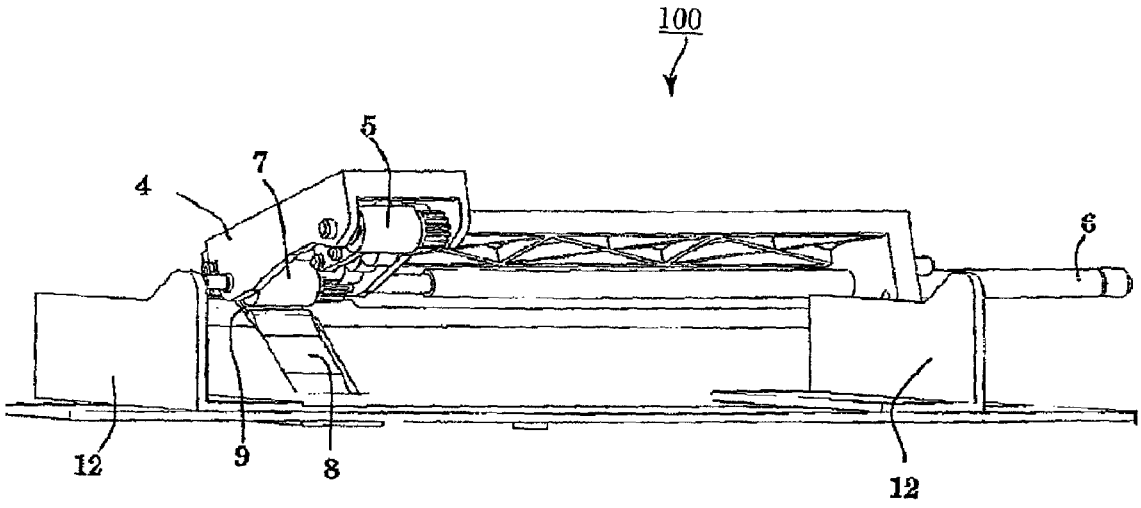
FIG. 4 is a perspective view of only the sheet feeder.

Next, the sheet feeder 10 will be described in detail with reference to FIGS. 3 and 4.

The sheet feeder 100 includes a conveying inclined surface 15 which is continuous from the sheet tray 11 in a downstream direction of the sheet feeding direction in the sheet tray 11 fixed to the apparatus main body. A pick arm (arm member) pivotally supported by a separation roller shaft (rocking shaft) 6 is disposed above a conveying inclined surface 15 such that the pick arm 4 can rock around the separation roller shaft 6 by an operation mechanism D such as a solenoid or motor in directions of arrows R1 and R2.

The paper feed roller 5 which comes into contact with a sheet which is accommodated in the sheet tray 11 and which conveys the sheet is disposed at an end 16 of the pick arm 4 on the upstream side in the sheet feeding direction. The separation roller 7 is disposed on the separation roller shaft 6 on which the pick arm 4 is pivotally supported such that the separation roller 7 is coaxial with the separation roller shaft 6. The separation roller shaft 6 which is a rotation shaft of the separation roller 7 and the rotation shaft 5*a* of the paper feed roller 5 are disposed in parallel to each other.

A pressure roller (pressure member) 2 is rotatably supported at end of the pick arm 4 on the downstream side in the sheet feeding direction. The separation pad 9 is in contact with the separation roller 7 under pressure. A sheet separator 17 comprises the separation roller 7 and the separation pad 9. The separation pad 9 is disposed in the separation pad holder (separation pad holding member) 8, and a pressure receiving roller (pressure receiving member) 3 is rotatably opposed to the pressure roller 2 of the pick arm 4 at an end of the separation pad holder 8 on the downstream side in the sheet feeding direction. These pressure roller 2 and pressure receiving roller 3 constitute a roller portion 19 which guides a sheet separated in the sheet separator 17 in a sending out direction from the sheet separator 17.

The separation pad holder 8 is rockably pivotally supported by a support shaft 8*a*. The separation pad 9 can come into contact and separate from the separation roller 7. The separation pad holder 8 is applied a force by a spring 20 which is a resilient member such that the separation pad 9 is in contact with the separation roller 7 under pressure.

After a sheet sent from the paper feed roller 5 reaches the sheet separator 17 and separates therefrom, the paper feed roller 5 separates the pick arm 4 from the sheet, and the operation mechanism D rocks in a direction in which pressure roller 2 presses the pressure receiving roller 3 of the separation pad holder 8.

Figure 5:
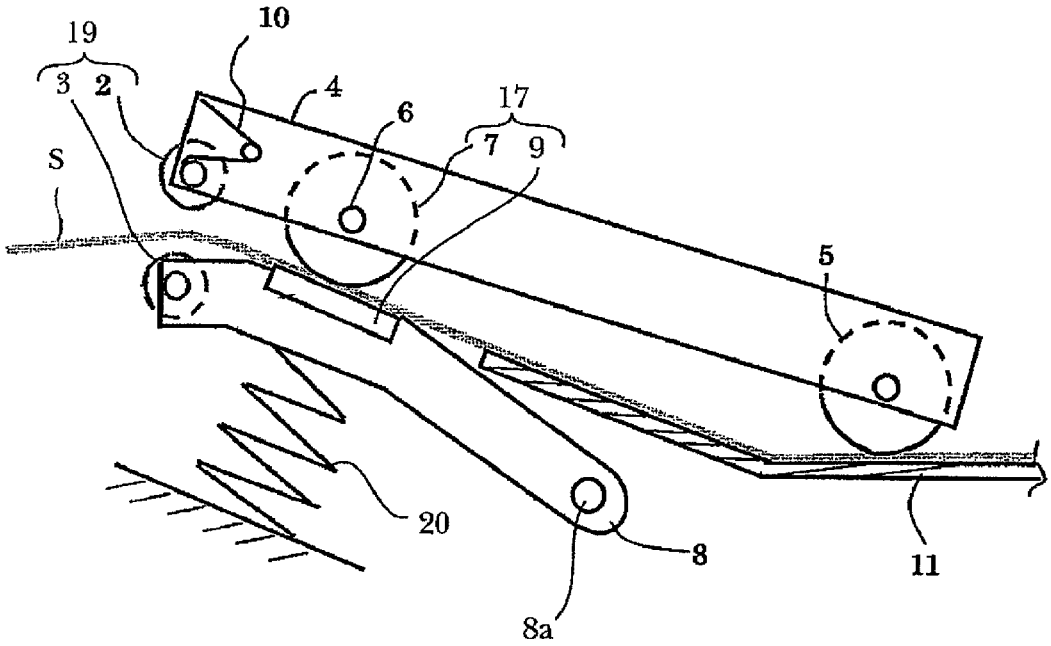
FIG. 5 is an explanatory diagram showing a state where a paper feed roller feeds a sheet.
Figure 6:
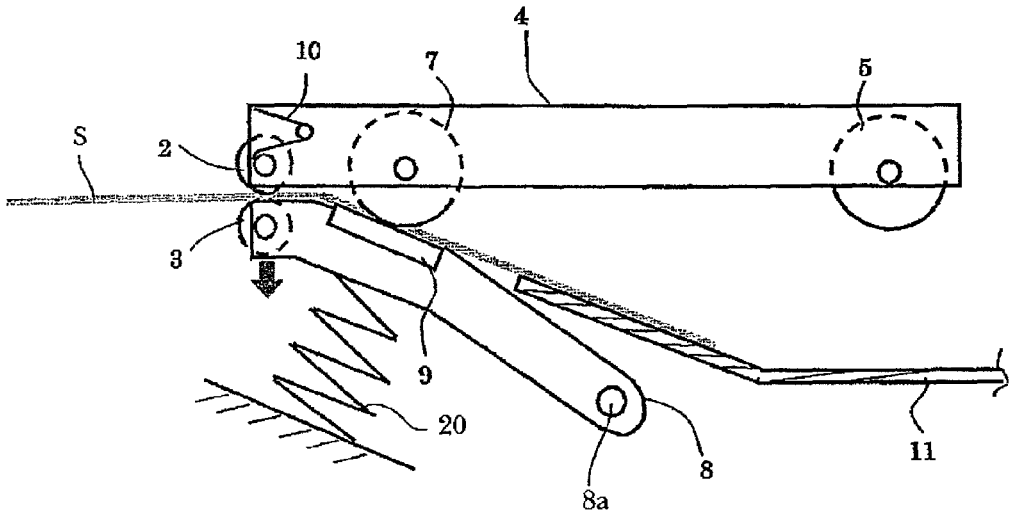
FIG. 6 is an explanatory diagram showing a state where the paper feed roller retreats.

The present invention is characterized in the operation when a sheet is fed in the sheet feeder 100. Next, this operation will be described with reference to FIGS. 5 and 6. FIG. 5 is an explanatory diagram showing a state where a paper feed roller 5 feeds a sheet. FIG. 6 is an explanatory diagram showing a state where the paper feed roller 5 retreats.

In a feeding state of sheet shown in FIG. 5, the pick arm 4 is rocked in a direction of the arrow pressure roller 2 (see FIG. 3). If the pick arm 4 is rocked, the paper feed roller 5 abuts against the uppermost surface of a batch of sheets on the sheet tray 11, and feeds the sheet toward the downstream side of the sheet feeding direction. At that time, the pressure roller 2 located at the end of the pick arm 4 on the downstream side of the sheet feeding direction is retreated to a position separated away from the pressure receiving roller 3.

At that time, since the sheet S which is being fed is conveyed while being sandwiched between the separation roller 7 and the separation pad 9, a back tension is applied to the sheet S. A reason why the back tension is applied to the sheet S is to reliably separate the batch of sheets by the separation roller 7 and the separation pad 9 (separate a sheet S from subsequent sheets).

After a tip end of the sheet S is fed to the sheet separator 17 constituted by the separation roller 7 and the separation pad 9 and the sheet is separated, the pick arm 4 rocks around the separation roller shaft 6 in a direction of the arrow R1 (see FIG. 3). With this, the paper feed roller 5 is retreated to the position shown in FIG. 6.

If the paper feed roller 5 retreats, the pressure roller 2 disposed at the rocking end of the pick arm 4 on the downstream side in the sheet feeding direction comes into contact with the pressure receiving roller 3 under pressure through the sheet S. As show in FIGS. 5 and 6, a rotation shaft or the pressure roller 2 is always applied a force toward the separation pad holder 8 by a torsion spring (biasing member) 10 which is a resilient member. With this, the pressure roller 2 absorbs a pressing force from the pressure receiving roller 3 and can press the pressure receiving roller 3 in the direction of the arrow shown in FIG. 6 under pressure of given value or more.

Figure 7:
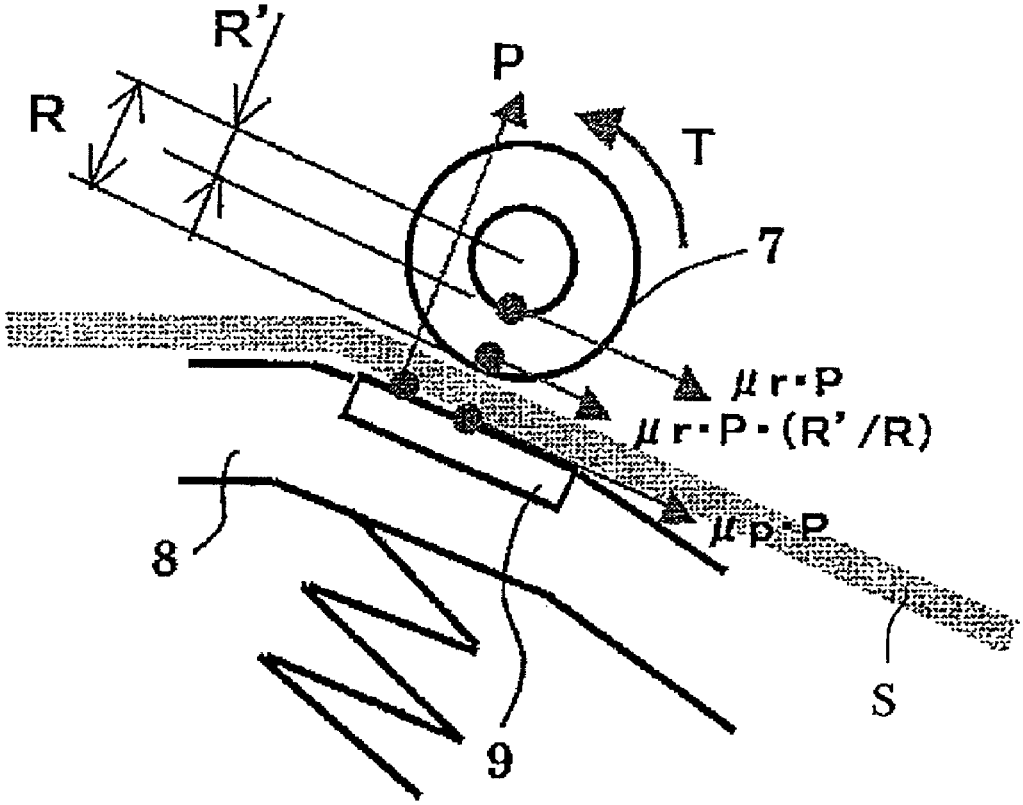
FIG. 7 is an explanatory diagram concerning a back tension of a sheet separator.
Figure 8:
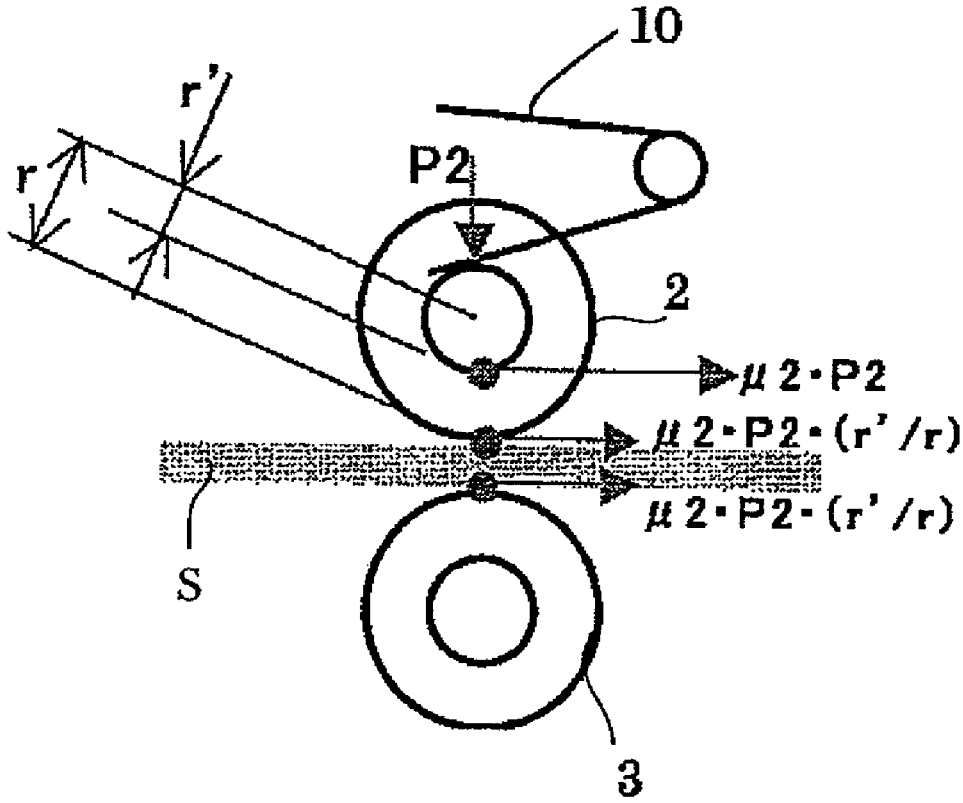
FIG. 8 is an explanatory diagram concerning a back tension of a roller portion.

Then, the separation pad holder 8 which supports the pressure receiving roller 3 is pushed down by a pressing force from the pressure roller 2, and a sheet separating pressure in the sheet separator 17 (pressure welding pressure between the separation roller 7 and the separation pad 9) is reduced. Therefore, the separation pad pressure is reduced, and the back tension in the sheet separator 17 is reduced. Next, the sheet separator 17 and the back tension in the roller portion 19 will be described with reference to FIGS. 7 and 8. FIG. 7 is an explanatory diagram concerning a back tension of the sheet separator 17. FIG. 8 is an explanatory diagram concerning a back tension of the roller portion 19.

As shown in FIG. 7, in the sheet separator 17, back tensions are applied between a sheet S and the separation roller 7, and between a sheet S and the separation pad 9. Here, $$\text{back tension of the sheet separator 17} = \mu p \times P + \mu r \times P \times (R'/R) + T/R,$$

wherein,

P: separation pad pressure,

T: load torque of separation roller 7,

μr: friction coefficient between separation roller shaft 6 and bearing,

μp: friction coefficient between sheet S and separation pad 9,

R: radius of separation roller 7, and

R': radius of separation roller shaft 6.

As shown in FIG. 8, in the roller portion 19, back tensions are applied between a sheet S and the pressure roller 2, and between a sheet S and the pressure receiving roller 3. Here, $$\text{back tension of roller portion 19} = 2 \times \mu 2 \times P2 \times (r'/r),$$

wherein,

P2: torsion spring pressure,

μ2: friction coefficient between roller shaft 2 and bearing r: radius of pressure roller 2, and r': radius of pressure roller 2.

Therefore, from the above-described relationships, the following equations can be obtained:

$$\text{back tension amount to be reduced} = \{\text{back tension of sheet separator 17 (at the time of pick up)}\}$$

$$-\{\text{back tension of sheet separator 17}\} \text{ (at the time of reduction operation)}$$

$$-\{\text{back tension of roller portion 19}\}$$

$$= \{\mu p \times P + \mu r \times P \times (R'/R) + T/R\}$$

$$-\{\mu p \times P' + \mu r \times P' \times (R'/R) + T/R\}$$

$$-\{2 \times \mu 2 \times P2 \times (r'/r)\}$$

$$= \{\mu p + (R'/R) \times \mu r\} \times (P - P')$$

$$-\{2 \times \mu 2 \times P2 \times (r'/r)\}, \text{ wherein}$$

P: separation pad pressure before back tension is reduced, and

P': separation pad pressure when back tension is reduced.

Therefore, although a back tension is generated also in the roller portion 19, its amount is very small, and the amount of back tension generated as a whole is reduced as a result.

In the above-described embodiment, the pick arm 4 is rocked by the operation mechanism D in the direction of the arrow R1. At that time, the pressure roller 2 presses the pressure receiving roller 3 and the separation pad holder 8 through a sheet S separated by the separation roller 7 and the separation pad 9, and the separation pad pressure between the separation roller 7 and the separation pad 9 is reduced. With this, it is possible to reduce the back tension generated by the separation roller 7 and the separation pad 9 with a small and simple mechanism. That is, after a sheet reaches the sheet separator 17 and the sheet is separated, the separation pad holder 8 is pressed the separation pad 9 is separated from the separation roller 7, and the back tension at the time of feeding operation of sheets can be reduced inexpensively.

Since the pressure roller 2 and the pressure receiving roller 3 presses a sheet S which is being conveyed near a downstream side of the sheet feeding direction in the sheet separator 17, it is possible to prevent a rear end of the sheet from jumping when the sheet S passes through the sheet separator 17, and the sheet can fed stably.

Figure 9:
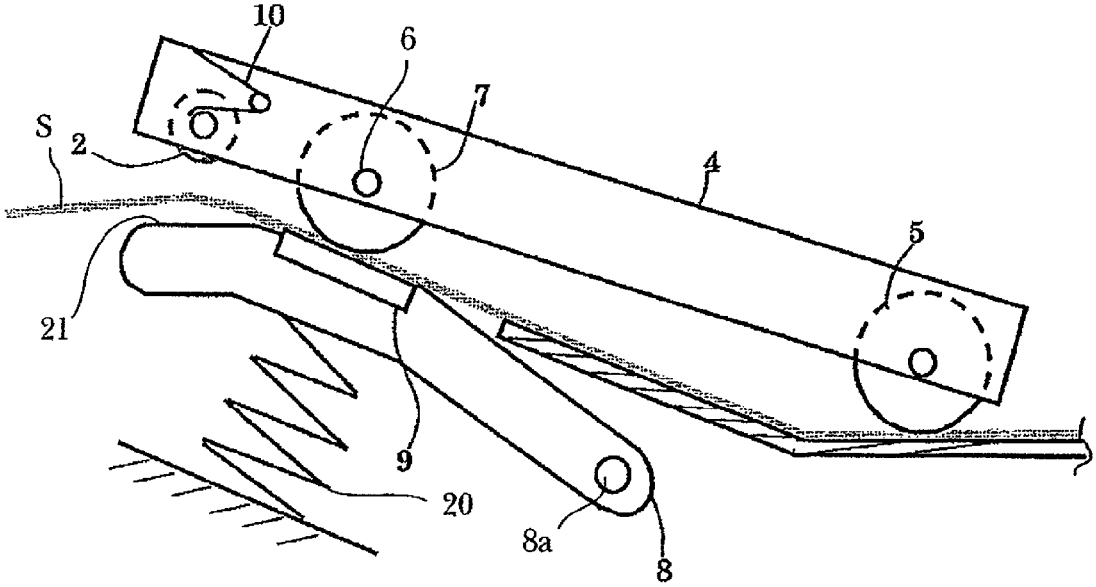
FIG. 9 is an explanatory diagram showing a state where a paper feed roller according to a second embodiment feeds a sheet.
Figure 10:
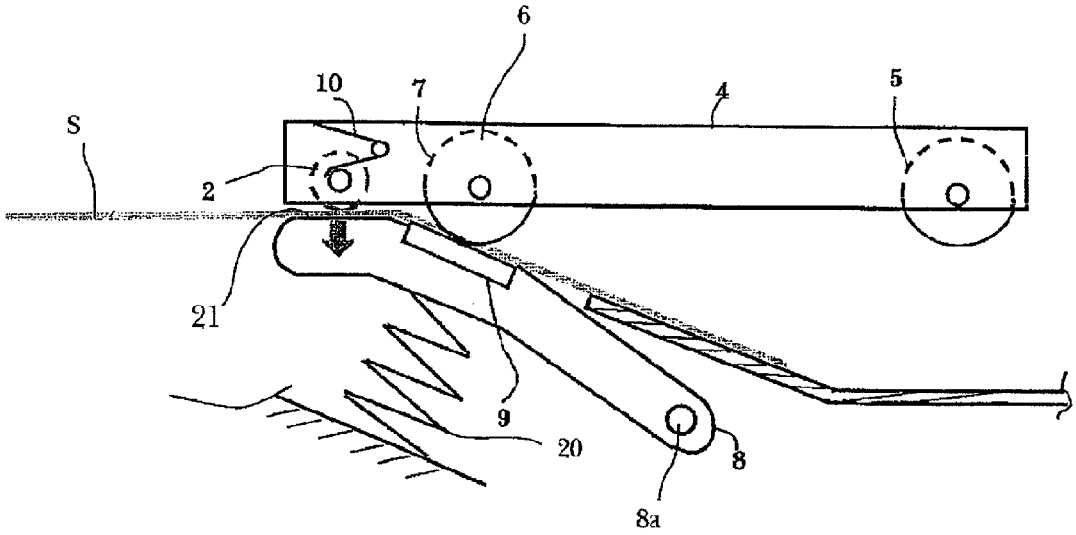
FIG. 10 is an explanatory diagram showing a state where the paper feed roller according to the second embodiment retreats.
Figure 11A:
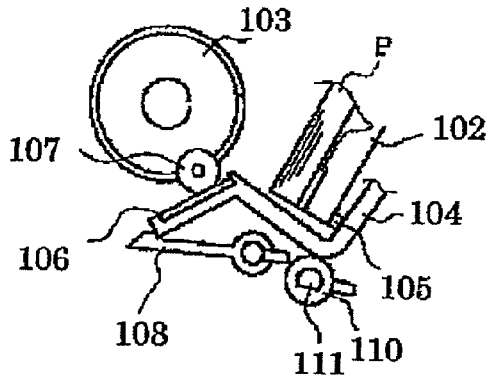
FIGS. 11A to 11F are explanatory diagrams of paper feeding operation of a conventional sheet feeder.
Figure 11D:
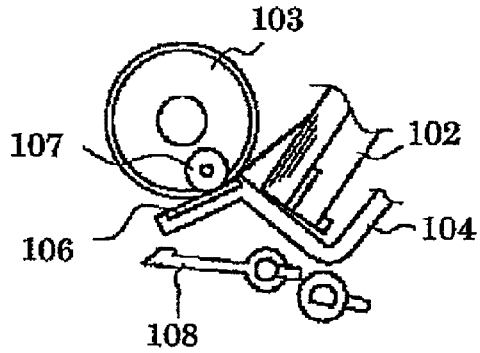
Figure 11B:
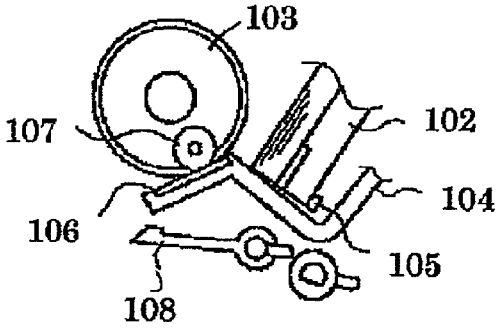
Figure 11E:
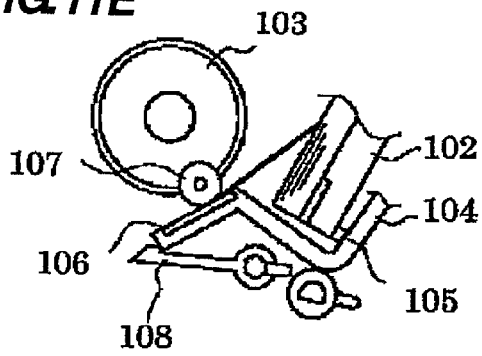
Figure 11C:
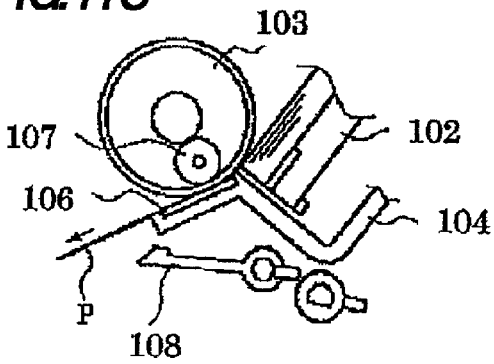
Figure 11F:
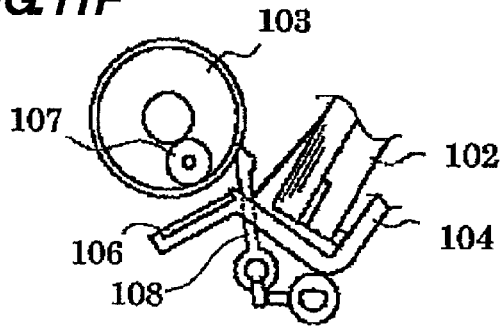

Next, a second embodiment of the present invention will be described. FIG. 9 is an explanatory diagram showing a state where the paper feed roller 5 according to the second embodiment feeds a sheet. FIG. 10 is an explanatory diagram showing a state where the paper feed roller 5 according to the second embodiment retreats. The same elements as those shown in FIGS. 1 to 8 are designated with the same reference numerals, and explanations thereof are used here.

A sheet feeder 100 of this embodiment is characterized in that the roller of the separation pad holder 8 is eliminated and only the pick arm 4 has the pressure roller 2. Therefore, when the pick arm 4 is rocked in the direction of the arrow R1, the pressure roller 2 presses a surface 21 of the separation pad holder 8 through the sheet S. The surface 21 is smoothly formed, and a friction resistance is small. Therefore, even if a sheet S is sent between the pressure roller 2 and the surface 21 in a state where the separation pad pressure is reduced, a friction load acting as a resistance at the time of paper feeding operation is low. Thus, if the structure shown in this embodiment is employed, a mechanism for reducing the back tension in the sheet feeder 100 can be made compact, simple and inexpensive, and the assembling performance can be enhanced.

Although the separation pad pressure is reduced to reduce the back tension in this embodiment, the separation roller 7 and the separation pad 9 may be separated from each other and the separation pad pressure may be set to 0.

The sheet feeder and the image forming apparatus of the present invention are effective for a sheet feeder having no middle plate, and are suitable for a sheet feeder and an image forming apparatus which must be small and simple.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-310816, filed Nov. 16, 2006, which is hereby incorporated by reference herein in its entirety.

What is claimed is:

1. A sheet feeder including a sheet tray which supports sheets, a paper feed roller which feeds the sheets supported by the sheet tray, and a sheet separator having a separation roller and a separation member which separates a sheet fed from the paper feed roller one by one, the sheet feeder comprising;

a holding member which holds the separation member and which is applied a force in a direction where the separation member comes into contact with the separation roller, a rockable arm member which is rockable provided and holds the paper feed roller on an upstream side in a sheet feeding direction, and which has a pressing portion capable of pressing the holding member on a downstream side in the sheet feeding direction, a pressure receiving portion which is provided on the holding member and abuts against the pressing portion, a biasing member which is provided on the arm member and applies a force to the pressing portion toward pressure receiving portion on the holding member, an operation mechanism which rocks the arm member in a direction where the paper feed roller is separated from the sheets supported by the sheet tray and the pressing portion presses the holding member, wherein after a sheet fed by the paper feed roller is separated by the sheet separator, the pressing portion presses the pressure receiving portion through the sheet while being applied a force by the biasing member as the arm member is rocked.

2. The sheet feeder according to claim 1, wherein after a sheet fed from the paper feed roller reaches the sheet separator, the operation mechanism rocks the arm member, the paper feed roller is separated from the sheets supported by the sheet tray, and the pressing portion is pressed against the holding member.

3. The sheet feeder according to claim 1, wherein the pressing portion is a pressing roller, and the pressure receiving portion is a pressure receiving roller.

4. The sheet feeder according to claim 1, wherein the sheet tray is fixed to an apparatus main body, and an inclined surface is disposed between the sheet tray and the sheet separator.

5. An image forming apparatus including a sheet tray which supports sheets, a paper feed roller which feeds the sheets supported by the sheet tray, a sheet separator having a separation roller and a separation member which separates a sheet fed from the paper feed roller one by one, and an image forming portion which forms an image on a sheet separated by the sheet separator, the image forming apparatus comprising;

a holding member which holds the separation member and which is applied a force in a direction where the separation member comes into contact with the separation roller, a rockable arm member which is rockable provided and holds the paper feed roller on an upstream side in a sheet feeding direction, and which holds a pressing member capable of pressing the holding member on a downstream side in the sheet feeding direction, a pressure receiving portion which is provided on the holding member and abuts against the pressing portion, a biasing member which is provided on the arm member and applies a force to the pressing portion toward pressure receiving portion on the holding member, an operation mechanism which rocks the arm member in a direction where the paper feed roller is separated from the sheets supported by the sheet tray and the pressing member presses the holding member, wherein after a sheet fed by the paper feed roller is separated by the sheet separator, the pressing portion presses the pressure receiving portion through the sheet while being applied a force by the biasing member as the arm member is rocked.

6. The image forming apparatus according to claim 5, wherein after a sheet fed from the paper feed roller reaches the sheet separator, the operation mechanism rocks the arm member, the paper feed roller is separated from the sheet, and the pressing member is pressed against the holding member.

* * * * *